US010502416B2

(12) United States Patent
Breccia et al.

(10) Patent No.: US 10,502,416 B2
(45) Date of Patent: Dec. 10, 2019

(54) GAS BURNER FOR CARAVANS, BOATS AND VEHICLES IN GENERAL

(71) Applicant: Defendi Italy S.r.l., Camerano (IT)

(72) Inventors: Luca Breccia, Camerano (IT); Werner Noeth, Camerano (IT); Marco Sbaffi, Camerano (IT)

( * ) Notice: Subject to any disclaimer, the term of this patent is extended or adjusted under 35 U.S.C. 154(b) by 0 days.

(21) Appl. No.: 16/077,115

(22) PCT Filed: Mar. 8, 2017

(86) PCT No.: PCT/IB2017/051353
§ 371 (c)(1),
(2) Date: Aug. 10, 2018

(87) PCT Pub. No.: WO2017/153928
PCT Pub. Date: Sep. 14, 2017

(65) Prior Publication Data

US 2019/0041056 A1 Feb. 7, 2019

(30) Foreign Application Priority Data

Mar. 10, 2016 (IT) ..... 2016A01538

(51) Int. Cl.
*F23D 14/06* (2006.01)
*F24C 3/08* (2006.01)

(52) U.S. Cl.
CPC ..... *F23D 14/06* (2013.01); *F24C 3/085* (2013.01); *F23D 2212/20* (2013.01); *F23D 2900/14061* (2013.01)

(58) Field of Classification Search
CPC ..... F23D 2900/14062; F23D 14/06; F24C 3/085; F24C 3/08; A47J 37/0713
See application file for complete search history.

(56) References Cited

U.S. PATENT DOCUMENTS

| | | | | |
|---|---|---|---|---|
| 2,486,278 | A * | 10/1949 | Harper | F23D 14/06 239/559 |
| 2,661,057 | A * | 12/1953 | Resek | F23D 14/06 239/424.5 |
| 5,875,974 | A | 3/1999 | Kwiatek | |
| 6,067,978 | A * | 5/2000 | Schlosser | A47J 37/0713 126/39 E |
| 9,217,571 | B1 * | 12/2015 | Frost | F24C 3/08 |
| 2011/0120444 | A1 | 5/2011 | Ryu | |
| 2011/0151385 | A1 | 6/2011 | Lona | |

* cited by examiner

*Primary Examiner* — Jorge A Pereiro
(74) *Attorney, Agent, or Firm* — Themis Law

(57) ABSTRACT

A gas burner for caravans, boats and vehicles in general includes an injector holder to be applied at an opening in a cooktop of a caravan, boat and/or vehicle in general and having an injector connected to a gas inlet; a burner cap resting on the injector holder and having a vertical conduit facing the injector at the bottom and leading, at the top, into a distribution chamber of the fuel mixture to generate a flame ring; and a cover resting on the burner cap and delimiting at the top the distribution chamber of the fuel mixture. At least two protruding pins are provided at the bottom surface of the cover and can be inserted into corresponding through holes in the burner cap to snappingly engage elastic coupling members coupled to the injector holder.

15 Claims, 6 Drawing Sheets

GAS BURNER FOR CARAVANS, BOATS AND VEHICLES IN GENERAL

Figure 1:
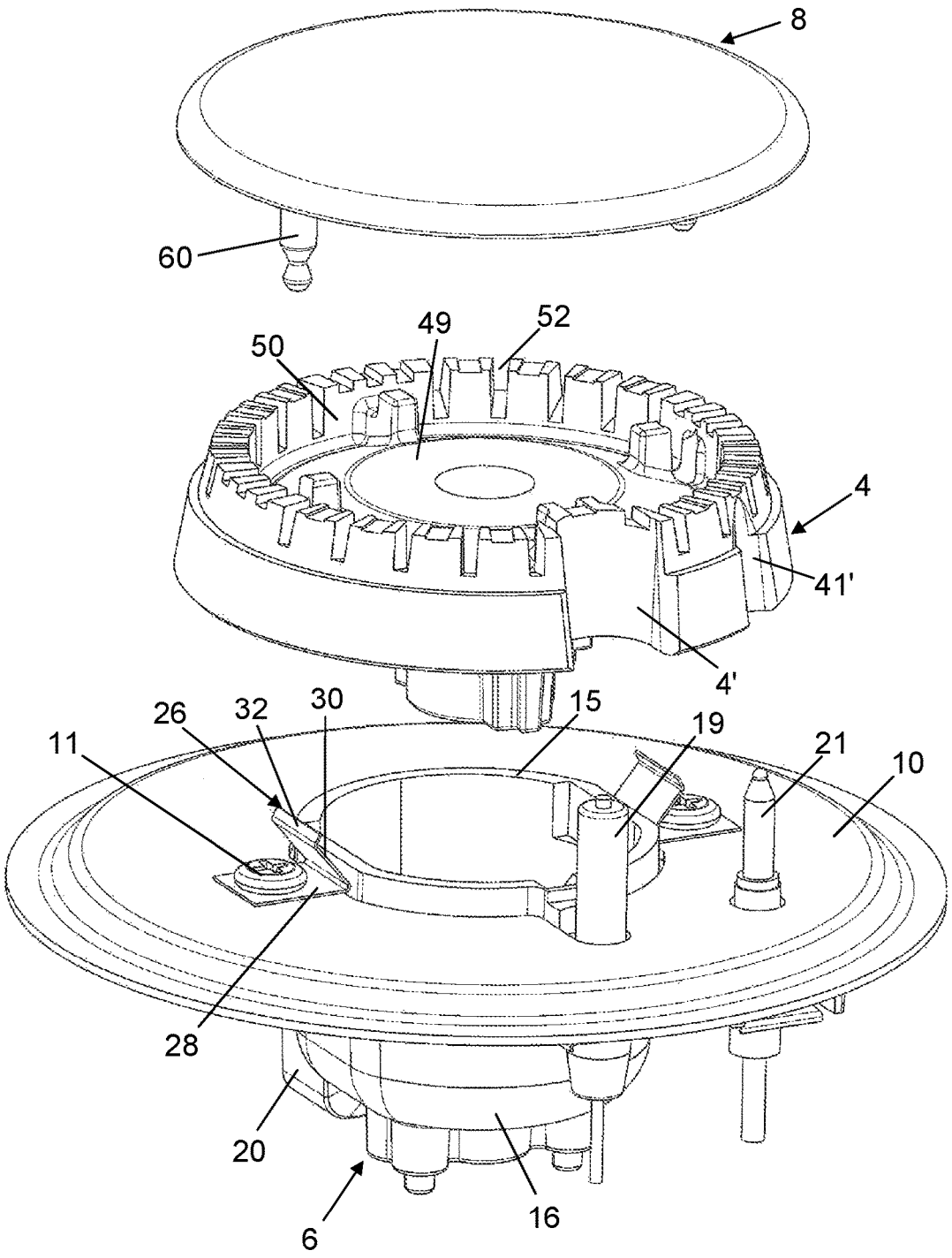

The present invention relates to a gas burner for caravans, boats and vehicles in general, i.e. a gas burner to be assembled on a cooktop intended to be used in a vehicle of any type.

Gas burners which are intended to be assembled on cooktops present inside a caravan, boat or vehicle in general are to be provided with a system for fastening the cover to the burner cap capable of avoiding the inevitable bumps generated inside the vehicle during its journeys from causing undesired and continuous vibrations or noises, up to reaching the detachment of the cover from the burner cap. For example, U.S. Pat. No. 6,067,978 describes a solution in which the cover is blocked to the burner cap by means of two pins which are inserted from the top downwards into corresponding through holes obtained in the burner cap itself.

Moreover, in such a background, the cover is generally blocked to the burner cap by means of two through screws which are inserted from the top downwards and which, after crossing both the cover and the burner cap, are screwed into two corresponding bushings also used to fasten the injector holder to the cooktop.

Such a solution is not satisfactory because the screws for fastening the cover to the burner cap remain visible and result in an unappealing appearance.

To eliminate this drawback, it has already been proposed to constrain a sheet plate to the burner cap by means of two fastening screws, which substantially act with the same methods described in the preceding solution, and also to obtain a threaded through hole in the middle of the sheet plate into which is screwed a threaded pin welded to the middle of the lower face of the cover.

This solution allows a satisfactory appearance to be obtained because once the burner is assembled, only the enameled cover remains visible, which completely hides both the sheet plate and the heads of the screws for fastening this to the burner cap.

However, this known solution is rather costly to make because it requires an additional component (the sheet plate) and requires additional operations for constraining this additional component to the burner cap and for welding the threaded pin to the lower surface of the enameled cover.

It is the object of the invention to make a gas burner to be installed on the cooktop of caravans, boats and vehicles in general which overcomes the drawbacks of traditional solutions.

It is another object of the invention to make a gas burner which has an overall pleasant appearance.

It is another object of the invention to make a gas burner which has a reduced number of components.

It is another object of the invention to make a gas burner which may be obtained with significantly reduced production costs.

It is another object of the invention to make a gas burner which can be assembled and disassembled in a very easy, quick and safe manner.

It is another object of the invention to propose a gas burner which has an alternative and/or improved characterization with respect to traditional ones, both in terms of construction and operation.

It is another object of the invention to make a gas burner which is simple and affordable to construct.

All these objects, both individually and in any combination thereof, and others which will become apparent from the description below, are achieved according to the invention with a gas burner with the features of claim 1.

Figure 2:
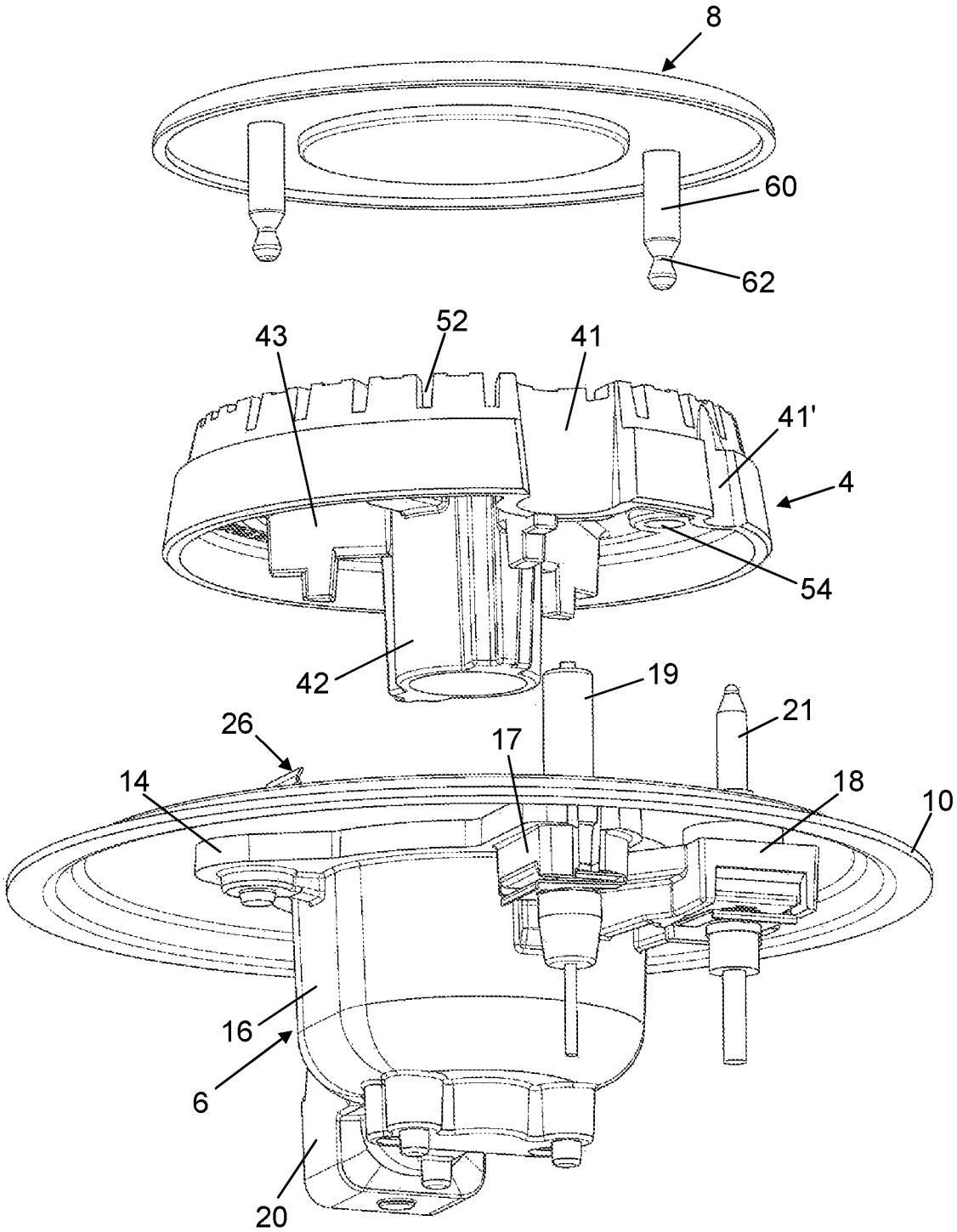
Figure 3:
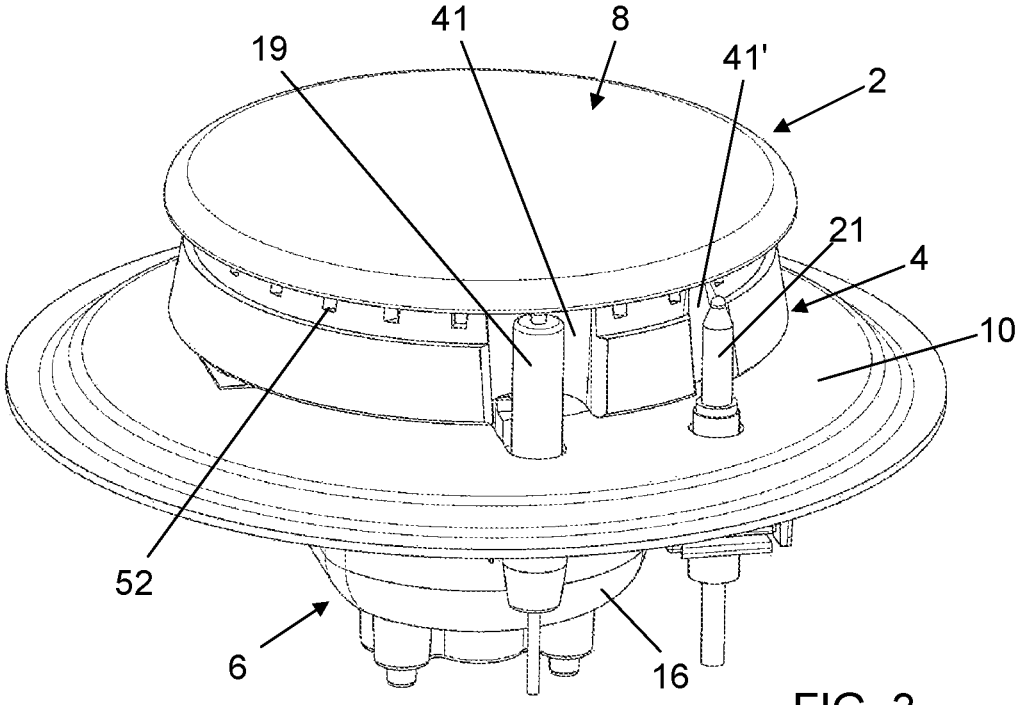
Figure 4:
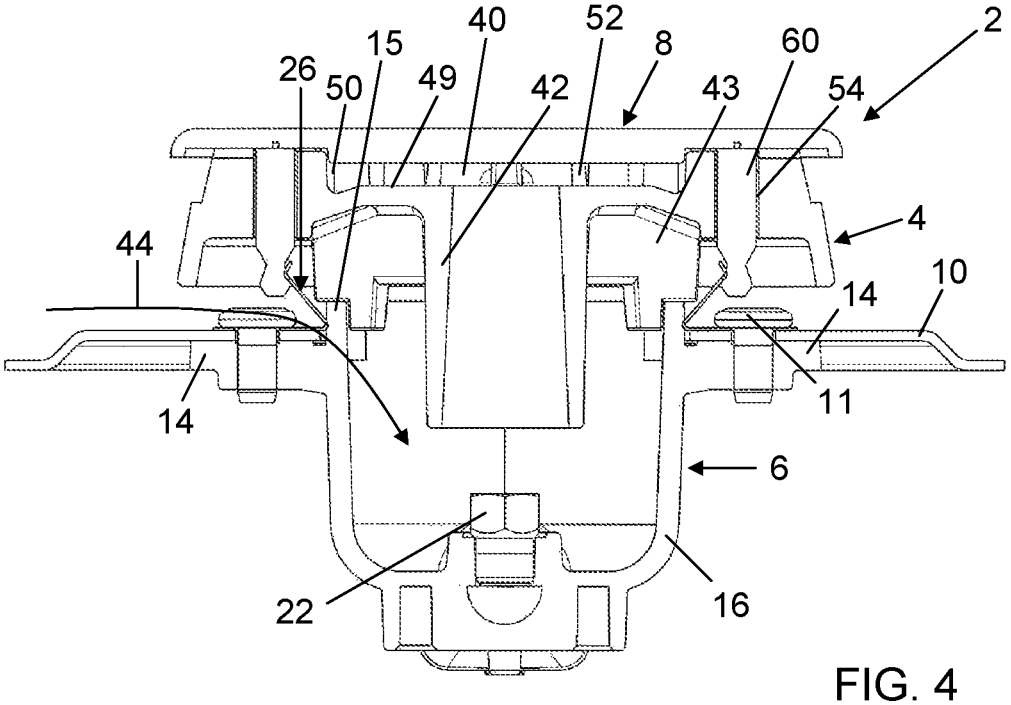
Figure 5:
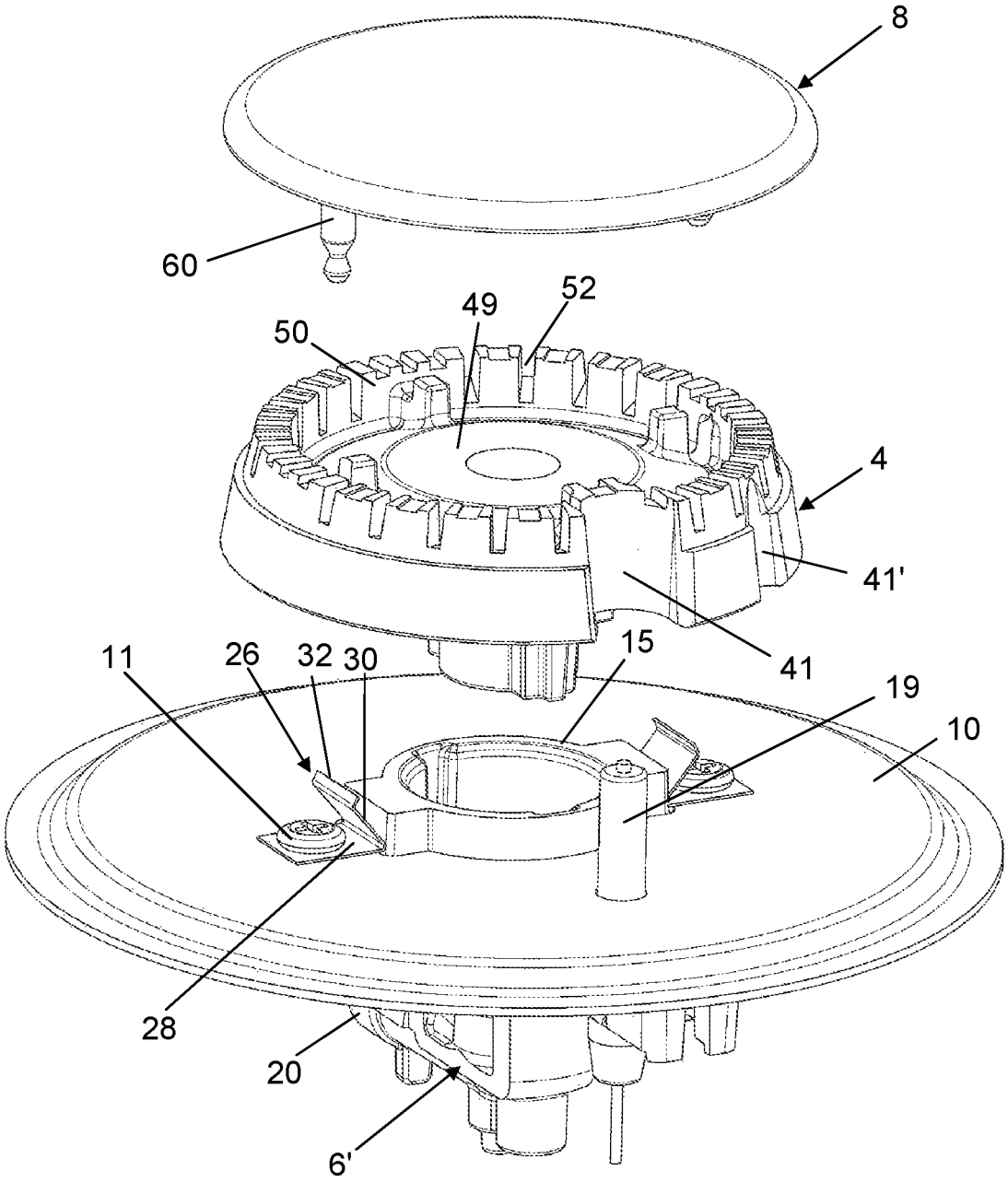
Figure 6:
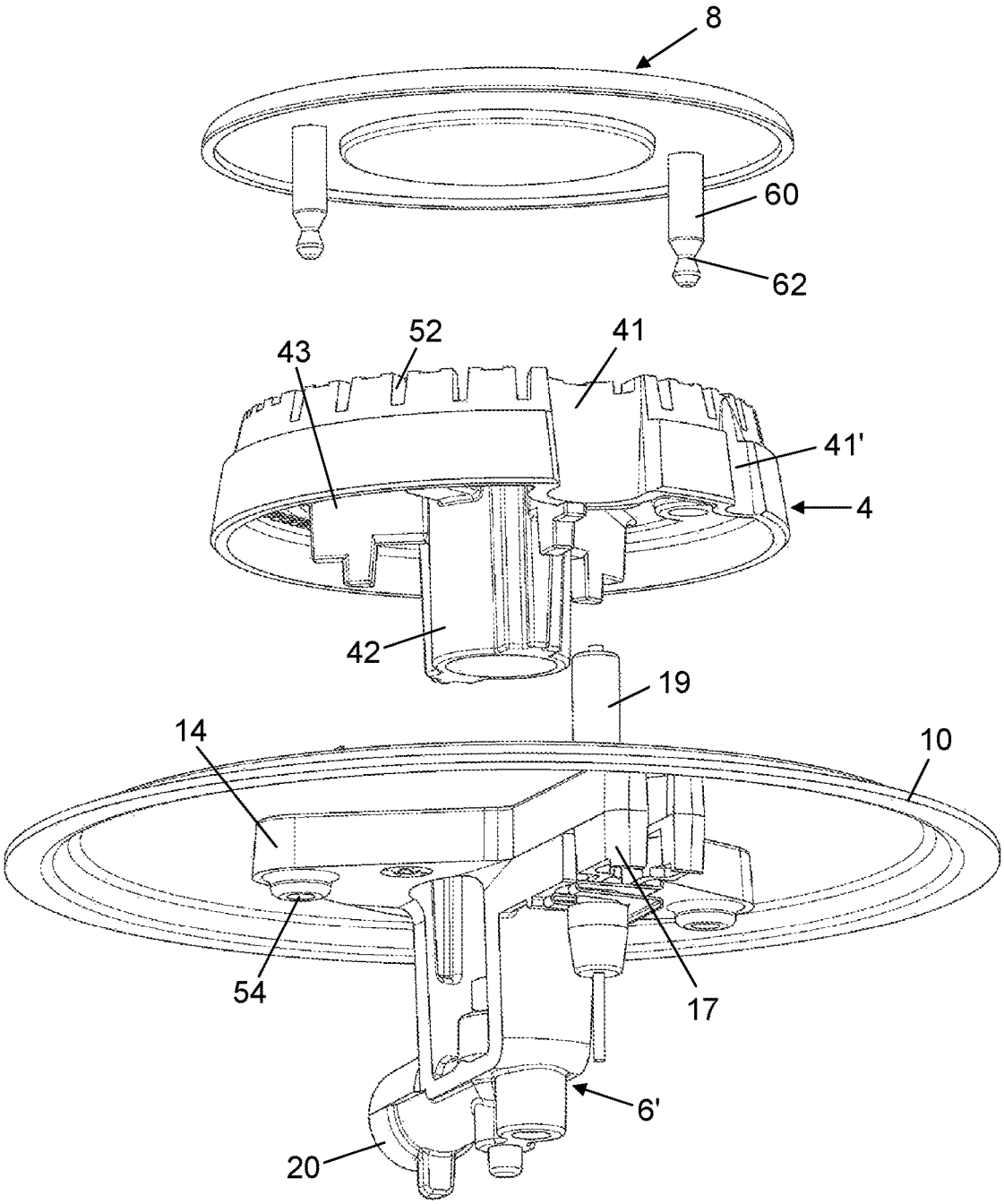
Figure 7:
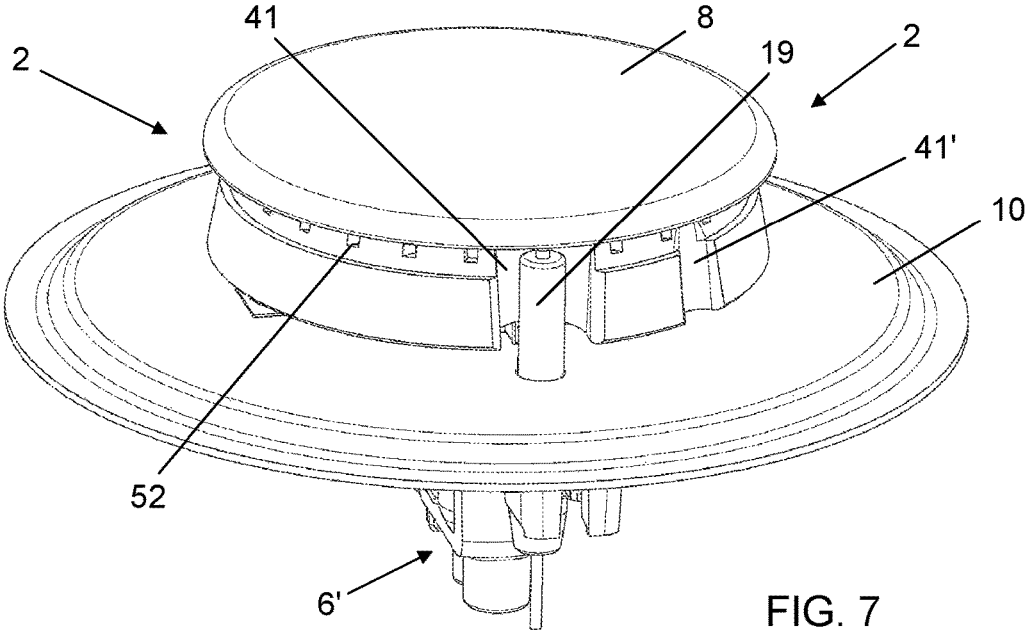
Figure 8:
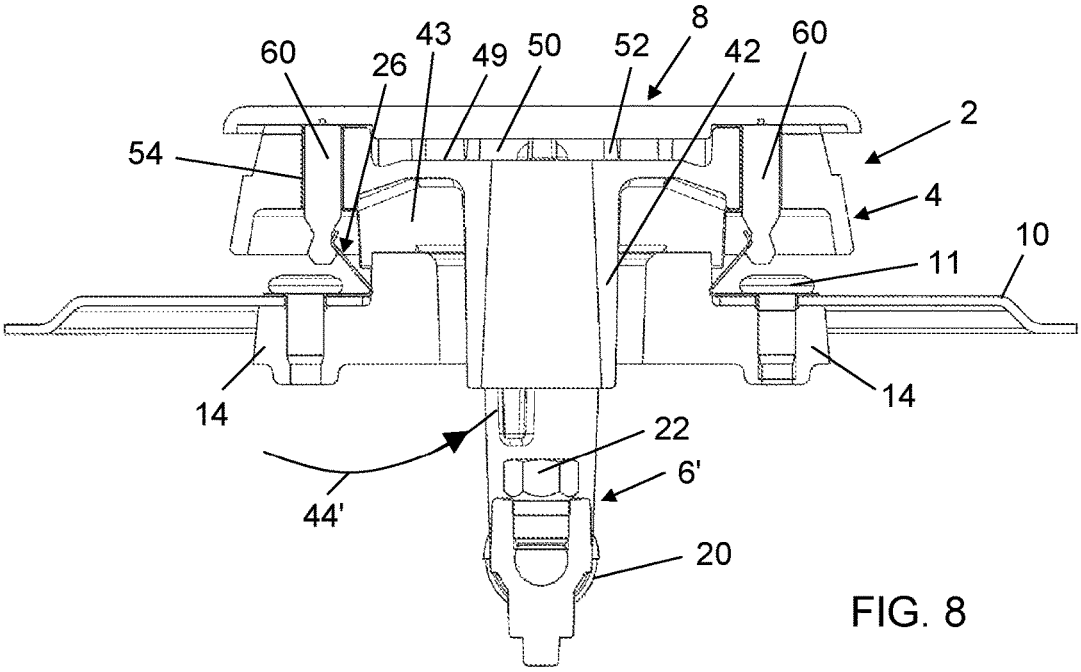

The present invention is hereinbelow further clarified in certain preferred embodiments thereof, which are described by mere way of non-limiting example, with reference to the accompanying drawings, in which:

FIG. 1 shows an exploded perspective top view of a burner according to the invention, in a first embodiment, FIG. 2 shows an exploded perspective bottom view of it, FIG. 3 shows a perspective top view of it, FIG. 4 shows a sectional vertical view of it, in assembled configuration, FIG. 5 shows it in the same view of FIG. 1, in a second embodiment, FIG. 6 shows it in the same view of FIG. 2, FIG. 7 shows it in the same view of FIG. 3, and FIG. 8 shows it in the same view of FIG. 4.

As shown in the drawings, in the embodiment illustrated in FIGS. 1 to 4, burner 2 according to the invention comprises a burner cap 4, which can be installed on an injector holder 6, and a cover 8.

In particular, the injector holder 6 is of the traditional type and is intended to be constrained to the cooktop 10 of a caravan or of a motorcaravan or of a boat or of a vehicle in general, by means of fastening screws 11.

In particular, the injector holder 6 comprises a cup-shaped support 16, which is completely closed both at the bottom and at the side and is open in the upper part, to allow the inlet of the primary air sucked from above cooktop 10. It is involved at the bottom by a connection 20 for a gas supply duct, which communicates with a vertical injector 22 centrally screwed onto the bottom of the cup-shaped support itself.

Advantageously, the side wall of the cup-shaped support 16 is provided with two flanges 14 protruding on the outside to adhere to cooktop 10 from below. In greater detail, two threaded through holes are obtained at the flanges 14, which are intended to be crossed by screws 11 for fastening the injector holder 6 to the sheet of cooktop 10.

Moreover, the side wall of the cup-shaped support 16 conveniently extends above the flanges 14 to define a collar 15.

Advantageously, the injector holder 6 comprises a first arm 17 for supporting a spark ignition 19 and a second arm 18 for supporting a thermocouple 21.

The burner according to the invention also comprises two or more elastic coupling means or clips 26 which are constrained, in diametrically opposite positions and facing one another, to the injector holder 6 and to the cooktop 10 by means of the fastening screws 11 themselves.

In particular, each clip 26 is formed by a section of metal sheet, preferably folded, and advantageously comprises a first horizontal stretch 28 which adheres to the upper surface of the sheet of cooktop 10, and then extends upwards in a second stretch 30 which is inclined outwards with respect to the preceding and ends with an edge 32 which is folded inwards.

The horizontal stretch 28 of each clip 26 has a through opening intended to be crossed by the corresponding fastening screw 11 which then crosses the sheet of cooktop 10 to engage in the threaded hole of the corresponding flange 14.

Advantageously, the stretch 28 of clip 26 extends horizontally up to substantially coming in contact with the outer surface of collar 15 of the injector holder 6.

The second stretch 30 forms the true elastic part of clip 26.

The burner cap 4 comprises an inner mixing/distribution chamber 40 which preferably has the radial Venturi effect and overall is circular in shape.

Conveniently, one or more recesses 41, 41' which define a suitable space for accommodating the spark plug 19 and/or for thermocouple 21 are provided at the circular edge of the burner cap 4.

The burner cap 4 also comprises a vertical conduit 42 which at the bottom faces injector 22 assembled on the injector holder 6 and at the top leads to the middle of the chamber 40 with the radial Venturi effect.

Conveniently, the lower surface of the burner cap 4 has shaped protrusions 43 which extend downwards and which rest on and/or are engaged in corresponding zones of the injector holder 6 so as to delimit passages between the burner cap 4 and the cup-shaped support 16 of the injector holder 6 for allowing the inlet into the cup-shaped support 16, of primary air 44 coming from above cooktop 10. More specifically, the lower part of each shaped protrusion 43 is involved by a step, at which the protrusion itself rests on collar 15 of the cup-shaped support 16 and also ensures the centering of the burner cap with respect to the injector holder.

Chamber 40 of the burner cap 4 is delimited at the bottom by a bottom 49, circumferentially by a side wall 50 and at the top by cover 8.

Wall 50 is involved by a plurality of doors 52 for exhausting the gas/primary air mixture and generating a flame ring. Conveniently, said doors 52 comprise main doors and secondary doors.

Two preferably cylindrical-shaped through holes 54 which are in diametrically opposite position to each other, are obtained close to the wall 50 of chamber 40 of the burner cap 4.

Cover 8 is circular in shape and preferably is enameled. Two pins 60 are provided at the lower face thereof and in diametrically opposite positions, which pins may be inserted from the top into the corresponding through holes 54 of the burner cap 4. When they are inserted, they ensure a stable coupling between cover 8 and the burner cap 4 and at the same time the centering of the first with respect to the second.

Preferably, the pins 60 are constrained by means of welding to the lower surface of cover 8. Moreover, close to the lower end thereof, they have an annular groove 62 in which the folded edge 32 of the inclined wing 30 of the clips 26 may be snappingly engaged.

Thereby, the clips 26 which are fastened to cooktop 10 by means of the same fastening screws 11 used to constrain the injector holder 6 to the cooktop itself, directly snappingly engage (i.e. with a particularly quick and easily reversible manner) the protruding pins 60 of cover 8 and crossing the burner cap 4 from side to side and thus they ensure a stable coupling and positioning of cover 8 on the latter.

The operation of the burner according to the invention is traditional because the gas which comes from duct 20 comes out of injector 22 and enters the vertical conduit 42 of the burner cap 4, dragging with it the primary air sucked from above cooktop 10 according to the path indicated by arrow 44 indicated in FIG. 4.

Advantageously, the fact that the primary air 44 is sucked from above cooktop 10 makes the burner according to the invention practically insensitive to the streaming phenomenon.

The flow of gas and primary air which begins to be mixed in the vertical conduit 42 then completes its mixing in the corresponding radial Venturi chamber 40 delimited at the top by cover 8.

The mixture thus obtained therefore supplies the flame ring which comes out of the doors 52 of the burner cap 4.

The embodiment illustrated in FIGS. 5 to 8 has all the essential and preferential as well as detailed features of the above-described embodiment illustrated in FIGS. 1 to 4, and differs from the latter by having a different injector holder 6' shaped like a bowl rather than a cup and involved by a plurality of openings for the inlet of the primary air coming from below cooktop 10 according to the path indicated by arrow 44' in FIG. 8. The remaining parts of the burner are identical to the ones of the preceding embodiment and are numbered in the same way. However, the resting on and centering of the burner cap 4 to the injector holder 6' occurs at steps obtained in the protrusions 43 of the burner cap 4, but more inwards with respect to the ones which ensure the support and the centering of the same burner cap to the cup-shaped injector holder 6 of the preceding embodiment.

It is in any case worth noting that according to the needs of the market, the burner may be provided with or without a spark ignition 19 and/or a thermocouple 21. In particular, the embodiment illustrated in FIGS. 5 to 8 is provided with a spark ignition 19 but it does not have a thermocouple 21. Here, the injector holder 6' is provided with a single arm 17 for supporting it, even if the burner cap 4 may, for manufacturing standardization needs, have both the recesses 41, 41', one of which accommodates the spark ignition 19 while the other one is unused.

It is apparent from what is said that the burner according to the invention is much more advantageous than traditional burners installed in cooktops of caravans, boats and vehicles in general, and in particular:

- it has an overall pleasant appearance since once assembled, externally it is similar to traditional burners, with the only visible portion consisting of the upper surface of the cover being completely enameled,
- it is simple and affordable to make because the clips are made of steel band and are fastened to the injector holder by means of the same screws used to constrain the latter to the cooktop; therefore they do not require any additional plates, nor particular screws or bushings, as in the case of traditional solutions,
- once the injector holder is fastened to the cooktop, the assembly and/or disassembly of the cover-burner cap assembly on/from the injector holder itself are particularly quick and simple and do not require any special tool, given their snapping constraining system obtained with the clips.

The invention claimed is:

1. A gas burner for caravans, boats and vehicles in general, comprising:

- an injector holder (6, 6') to be applied at an opening to be made in a cooktop (10) of a caravan, boat or vehicle in general, said injector holder (6, 6') being provided with at least one injector (22) which is connected to at least one gas inlet (20);
- a burner cap (4) resting on said injector holder (6, 6') and comprising a vertical conduit (42) facing, at a bottom, said injector (22) and, at a top, leading into a distribution chamber (40) of a fuel mixture, to generate at least one flame ring; and
- a cover (8), resting on said burner cap (4) and delimiting, at a top, said distribution chamber (40) of the fuel mixture, further comprising, at a bottom surface of said cover (8), at least two protruding pins (60) disposed to be inserted into corresponding through holes (54) made in said burner cap (4) and to snappingly engage elastic coupling members (26) associated with said injector holder (6, 6').

2. The gas burner according to claim 1, wherein said elastic coupling members (26) are associated with said injector holder (6, 6') with screws (11) that also fasten said injector holder (6, 6') to said cooktop (10).

3. The gas burner according to claim 1, wherein each elastic coupling member (26) comprises a strip of metal sheet.

4. The gas burner according to claim 1, wherein each elastic coupling member (26) is in contact, at an end thereof, with one of the at least two protruding pins (60).

5. The gas burner according to claim 1, wherein each elastic coupling member (26) is formed by a folded strip of metal sheet and comprises:

a first horizontal stretch (28) provided with a through opening for a crossing of a screw (11) for fastening the injector holder (6, 6') to the cooktop (10), and a second stretch (30) emerging upwards from said first horizontal stretch (28) and defining an elastic wing of said elastic coupling member (26).

6. The gas burner according to claim 5, wherein said second stretch (30) of each elastic coupling member (26) is inclined outwards and has a folded upper end (32), said folded upper end being configured to engage in a corresponding groove (62) obtained close to a bottom end of a respective protruding pin (60).

7. The gas burner according to claim 1, wherein said through holes (54) are provided in said burner cap (4) at a side delimiting wall (50) of said distribution chamber (40).

8. The gas burner according to claim 1, wherein said at least two protruding pins (60) are welded to a bottom surface of said cover (8).

9. The gas burner according to claim 1, wherein a bottom surface of the burner cap (4) has shaped protrusions (43) for resting and centering with respect to the injector holder (6, 6').

10. The gas burner according to claim 1, wherein, when said burner cap (4) rests on said injector holder (6), said burner cap delimits, with said injection holder, passages for an inlet into the injector holder (6) of primary air (44) coming from above said cooktop (10).

11. The gas burner according to claim 1, wherein said injector holder (6') has openings to allow an inlet therein of primary air (44') coming from below the cooktop (10).

12. The gas burner according to claim 1, wherein said cover (8) is circular and enameled.

13. The gas burner according to claim 1, wherein there are two protruding pins (60) coupled to said cover (8), two corresponding through holes (54) of said burner cap, (4) and two elastic coupling members (26) which are in diametrically opposite positions and facing each other.

14. The gas burner according to claim 1, wherein said distribution chamber (40) of the fuel mixture provides a radial Venturi effect.

15. The gas burner according to claim 1, wherein said injector holder (6) comprises a support arm for one or both of a spark ignition (19) or a thermocouple (21).

* * * * *